United States Patent [19]

Wusthof et al.

[11] Patent Number: 4,838,765

[45] Date of Patent: Jun. 13, 1989

[54] AXIAL PISTON PUMP

[75] Inventors: Peter Wusthof, Lohr; Egon Eisenbacher, Karlstadt; Manfred Lotter, Neu-Ulm; Rainer Stölzer, Ulm, all of Fed. Rep. of Germany

[73] Assignee: Mannesmann Rexroth GmbH, Jahnstrasse, Fed. Rep. of Germany

[21] Appl. No.: 898,837

[22] Filed: Aug. 20, 1986

Related U.S. Application Data

[63] Continuation-in-part of Ser. No. 796,437, Nov. 8, 1985, abandoned.

[30] Foreign Application Priority Data

Nov. 8, 1984 [DE] Fed. Rep. of Germany ..... 3440850

[51] Int. Cl.[4] ..... F04B 23/14; F04B 1/04

[52] U.S. Cl. ..... 417/203; 417/269

[58] Field of Search ..... 417/203, 206, 269

[56] References Cited

U.S. PATENT DOCUMENTS

| | | | |
|---|---|---|---|
| 2,392,543 | 1/1946 | Mercier | 417/203 |
| 2,918,879 | 12/1959 | Ceruo | 417/269 |
| 3,209,701 | 10/1965 | Phinney | 417/260 |
| 3,498,229 | 3/1970 | Preslesnik | 417/269 |
| 3,663,122 | 5/1972 | Kitchen | 417/269 |
| 4,301,716 | 11/1981 | Saegusa | 417/269 |
| 4,576,554 | 3/1986 | Wagonseil | 417/270 |

*Primary Examiner*—William L. Freeh

*Attorney, Agent, or Firm*—Cushman, Darby & Cushman

[57] ABSTRACT

The invention relates to a pump, in particular to an axial piston pump of the swash plate type, wherein the suction pressure medium is fed into the swash plate chamber, so as to be arranged in layers of different pressure. The pressure medium is removed from a desired pressure layer and supplied to the pump chamber so as to obtain a desired pump flow characteristic.

17 Claims, 3 Drawing Sheets

AXIAL PISTON PUMP

This is a continuation-in-part of application Ser. No. 796,437, filed Nov. 8, 1985 which was abandoned upon the filing thereof.

The invention relates to an axial piston pump of the type set forth in the preamble of claim 1. The principle of the present invention may, however, also be used for other types of pumps.

When pumps are used together with hydraulic systems, it is frequently desirable that the pump flow depending on the pump speed (pump flow characteristic) should remain constant after an initial increase or, should even decrease after that initial increase. If such a pump is used together with a power steering system of an automobile then there exists the possibility that a large pump flow is provided if the car is being parked or driven slowly while a low pump flow is provided if the car is driven at high speeds where only small steering corrections are necessary. With the above-mentioned pump flow characteristic power will be saved, and this power saving will eventually result in a lower gas consumption of the automobile. It should be noted that for certain applications also a slowly decreasing pump flow characteristic may be desirable.

German Pat. No. 32 31 878 discloses a radial piston pump with pump means supplying a main flow. At the suction side of said pump a variable resistance is incorporated which reduces the flow of suction. The resistance has the form of a mechanically driven disc which will decrease the flow of suction if the speed is increased. When the pump is driven, the disc will generate a local circular flow, a flow which will increase depending on the speed and will also impede the flow of suction of the pistons of the pump. This way the desired falling pump flow characteristic is achieved. It should be noted, however, that an additional rotatably mounted component is required which has no other functions.

German pat. appln. No. 25 40 879 published for opposition relates to a multiple cylinder piston pump and comprises in detail a radial piston pump and also an axial piston pump. Said known pumps use segment-shaped recesses, so as to avoid high pressure peaks and an increased noise level. Said recesses cooperate with a leaf spring valve. The pressure medium is supplied to the axial piston pump substantially along the longitudinal axis of the pump into a suction chamber adjacent to the end of the swash plate shaft. Inlet channels extend from the suction chamber to the piston chambers of the axial pumps. The inlet ports provided for said pumps do not allow a layering of the pressure medium, and therefore is is not possible to achieve, for instance, a falling or decreasing pump flow characteristic.

It is an object of the present invention to provide an axial piston pump having a low power requirement. Another object of the present invention is to provide a piston pump adapted to be used for the power steering system of a car, so that a better steering characteristic may be obtained.

A still further object of the present invention is to provide a pump which provides a pump flow characteristic such that for higher speeds the relationship between the pump flow and the speed will decrease (falling characteristic), so that for said higher speeds a smaller amount Q of oil or pressure medium is provided.

It is another object of the present invention to provide an axial piston pump which provides for a falling pump flow characteristic in a simple and cost efficient manner.

In accordance with a still further object of the present invention an axial piston pump is provided having a first plurality of axial pistons arranged in a first plurality of piston chambers and further comprising a second plurality of axial pistons arranged in a second plurality of piston chambers, wherein said first plurality of piston chambers is supplied with pressure medium having a first pressure, while said second plurality of piston chamber is supplied with pressure medium having a second pressure.

According to another object of the invention, said first plurality of piston chambers supply pressurized medium to the power steering system of a car, while said second plurality of piston chambers supplies pressurized medium to other pressure operated components of the car, for instance, the hydraulic brake system, level adjusting means, and clutch systems, respectively. Generally speaking, a first and/or second load are supplied by the pump of the invention.

SUMMARY OF THE INVENTION

The present invention provides for a pump in which the pressure medium at the suction side is provided for in different layers of pressure, i.e. a pressure gradient is created. In accordance with the invention the pressure medium will be sucked away from an area having the lowest pressure and is then supplied to the piston chambers of the pistons. It is preferred to provide for the layers of pressure by introducing the pressure medium into a pump chamber, a pump chamber in which a rotary member of the pump is located, a rotary member which is necessary anyway. In accordance with a preferred embodiment of the invention the pressure medium on the suction side of the pump is supplied to the swash plate chamber. The input of the pressure medium is carried out in a radial direction from the outside and the removal of the pressure medium from the swash plate chamber is preferably carried out as close as possible to the longitudinal axis of the pump. In this manner the pressure medium at the suction side of the pump will be definitely sucked away from the area of having the lowest pressure, and it will be supplied from there to the piston chambers. An advantage of this arrangement is that the pump will continue its operation in a case of emergency, i.e. in a situation where the amount of oil is low.

In accordance with a modification of the invention it is possible to provide for a horizontal and even for an increasing flow characteristic. This is made possible by drawing the pressure medium at the suction side from an area of a layer which has an appropriate pressure value. For instance, if the removal of the pressure medium occurs from the swash plate chamber in a radial outermost position adjacent to the inner wall of the housing, then a flow characteristic having maximum increase will be achieved.

In accordance with another embodiment of the invention an axial piston pump is provided having a first plurality of piston chambers, said second plurality comprising fewer piston chambers than said first plurality, and wherein the first plurality of piston chambers is supplied with pressure medium drawn from a low pressure region of the pressure medium in the swash plate chamber, while the second plurality of piston chambers is supplied with pressure from a high pressure region of the pressure medium in said swash plate chamber.

Additional advantages, objects and details of the invention will be found in the following description of embodiments which are shown in the drawing:

FIG. 6 is a cross-sectional view of similar to FIG. 1 of another embodiment of the pump together with a schematic representation of the hydraulic circuit supplied by said pump.

The invention will be described in connection with an axial piston pump. However, the invention may also be used for other types of pumps.

Figure 1:
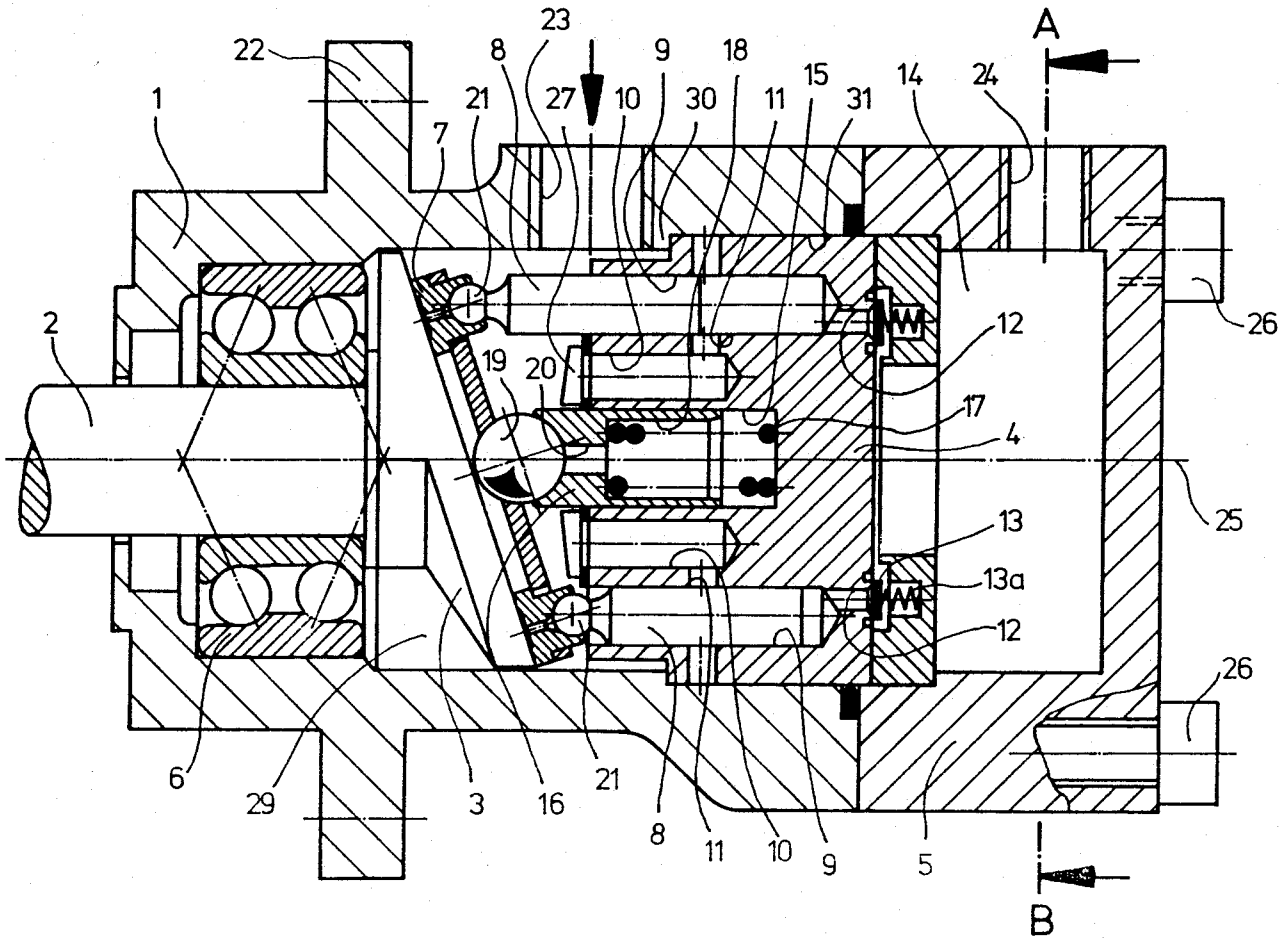
FIG. 1 is a longitudinal cross-section of the pump of a first embodiment of the invention.
Figure 2:
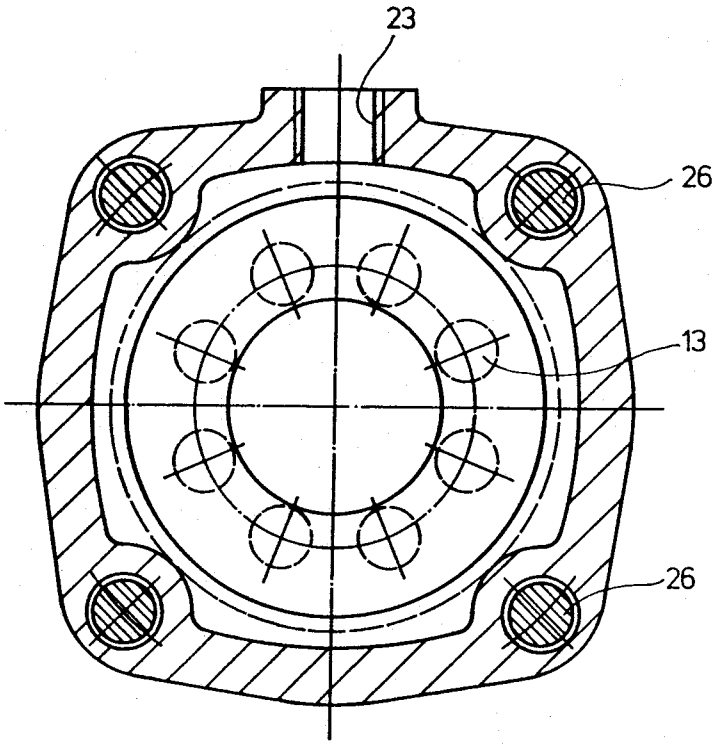
FIG. 2 is a cross-sectional view along line A—B in FIG. 1.

The axial pump of FIGS. 1 and 2 comprises a fixedly mounted housing 1 in which a drive shaft 2 is rotatably mounted by means of a ball bearing 6. The drive shaft 2 supports at its end which ends inside the housing 1 a swash plate 3. Housing 1 comprises an axial bore 31 which defines a swash plate chamber 29 adapted to receive said swash plate 3. The axial bore 31 further contains a cylinder body (piston support) 4 which abuts against a radially extending annular shoulder 30 formed by the bore 31 of the housing. The cylinder body 4 is held in place by a housing cover 5. The housing cover 5 is fixedly mounted to housing 1 by means of bolts 26.

A plurality of bores 9 is provided within said cylinder body 4. Said bores extend parallel to the longitudinal or middle axis 25 of the pump housing 1. Axial pistons 8 are located in the appropriate piston bores 9. The embodiment shown discloses, for example, six bores 9 which are arranged on a circle. Radially and inwardly offset with respect to said bores 9 are inlet bores 10 which also are located on a circle. In the shown embodiment for each inlet bore 10 each one appropriate piston bore 9 is provided. For an appropriate position of the piston 8, each inlet bore 10 is connected via a suction bore 11 with the appropriate piston bore 9. It is also possible to provide one inlet bore 10 for a plurality of piston bores 9. Each piston bore 9 ends in an exhaust channel 12. The exhaust channel 12 is kept closed by means of a valve plate 13 during suction of the pressure medium. The valve plate 13 is under the action of a spring 13*a*.

Further, a middle bore 15 extends along the middle axis 25 of the housing within the cylinder body 4. Said middle bore 15 is adapted to receive a piston 16. A spring 17 located in a bore 18 of the piston 16 is adapted to press the piston 16 via a ball 19 against the swash plate 3. Said bore 18 is connected with the ball seat surface of the ball 19 via a channel 20.

Each piston 8 comprises a ball-shaped head 21. Each of said ball heads 21 is received in a piston support body 7 which, in turn, is supported by the swash plate 3.

The piston bores 9 are connected at their ends opposite to the swash plate 3 to an exit chamber 14 by means of exhaust channels 12.

FIG. 2 discloses the design of the valve plates 13, each of which being adapted to cover the exhaust channels 12.

Each inlet bore 10 is provided at its inlet end with a flow guide element 27.

The intake pressure medium is supplied to the swash plate chamber 29 by means of an inlet channel 23 provided in housing 1. The pressure medium in removed from the pump by means of an outlet channel 24 in cover 5.

In accordance with the present invention the intake pressure medium is supplied to the swash plate chamber 29, and in said swash plate chamber 29 the pressure medium is arranged in layers of different pressure due to the rotation of the swash plate 3. In accordance with the invention, the pressure becomes larger with an increasing radial distance with respect to the middle axis 25. The pressure has its lowest value at the middle axis 25. Therefore, the area of the lowest pressure is close to the middle axis 25.

The pressure gradient created by the rotation of the swash plate 3 exists, of course, only in immediate vicinity of the rotating surface of the swash plate 3. Therefore, the openings of the suction or inlet bores 10 must be as close to the rotating surface as possible. Preferably, the separation should be in the range of 1 mm to 5 mm for a pump of a displacement capacity of 5 $cm^3$ through 32 $cm^3$.

In accordance with the present invention, the suction pressure medium which has to be supplied to the piston bores 9 is taken from the area of the lowest pressure. In the embodiment shown the pressure medium is removed from the area of lowest pressure by means of the inlet bores 10, which are arranged immediately adjacent to the middle axis 25. Due to the fact that with an increase of the rotational speed the "pressure layering" (i.e. the arrangement of the pressure medium in layers of different pressure) will increase further, a sufficient amount of suction throttling occurs, so that the characteristic Q/n will show the desired decrease when the speed increases.

Q is the amount of pressure medium supplied by the pump and n is the rotary speed. The flow guide elements 27 will improve this result.

Figure 3:
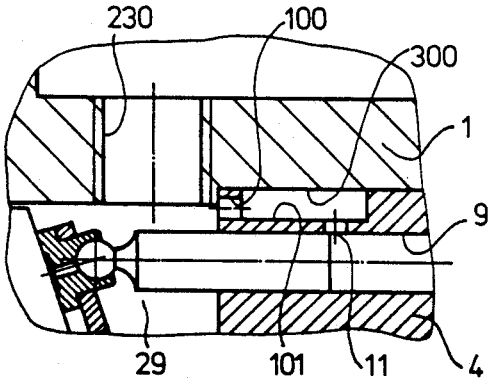
FIG. 3 is a partial cross-sectional view similar to FIG. 1 of another embodiment of the invention.

FIGS. 1 and 2 disclose a preferred embodiment of the invention. FIG. 3 discloses another embodiment of the invention shown in the form of a partial sectional view in the area of the inlet channel 230. FIG. 3 discloses another possibility for the arrangement of the inlet bores 100 which are adapted to transport pressure medium from the swash plate chamber 29 to the piston bores 9 via suction bores 11. A recess 101 in the piston body 4 connects the inlet bores 100 with the appropriate suction channels 11.

In accordance with the embodiment of FIG. 3 pressure medium is removed from a pressure layer area in the swash plate chamber 29 where the highest pressure exists. Due to this fact it is possible to obtain an increasing, at least however a horizontal pump flow characteristic. It is to be recognized that pressure medium can be removed from different areas of pressure in the swash plate chamber 29 by proper suction means, so as to achieve the required pump flow characteristic. While the embodiment of FIGS. 1 and 2 discloses suction means located at an innermost radial position with respect to the middle axis 25 of the pump, the embodiment of FIG. 3 discloses the suction means at a radial outermost location adjacent to the inner wall 300 of the housing.

Figure 4:
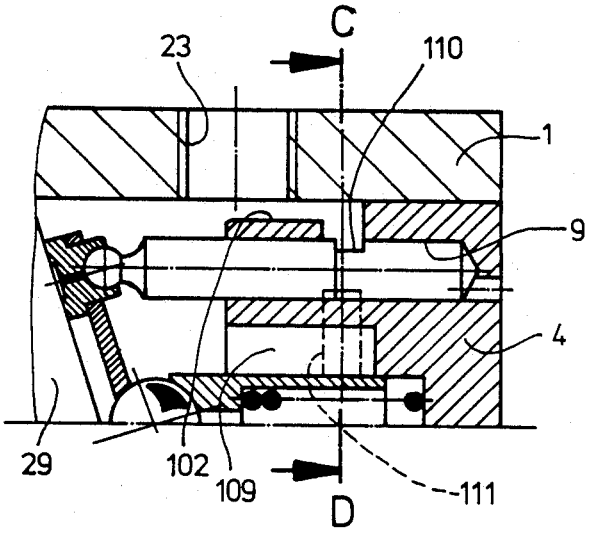
FIG. 4 is a partial cross-sectional view similar to the view of FIG. 3 of another embodiment of the invention.
Figure 5:
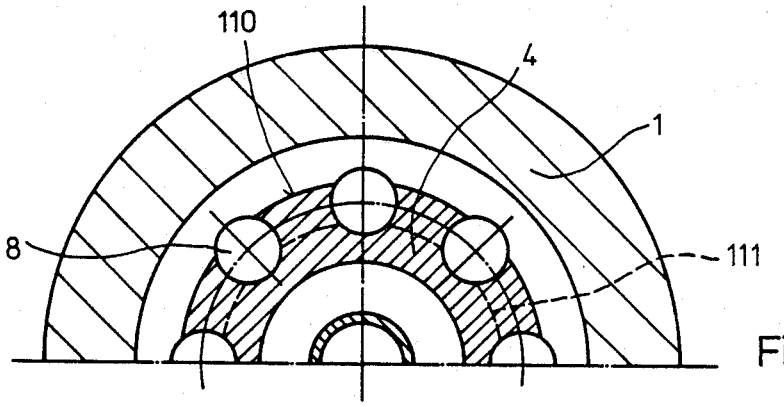
FIG. 5 is a cross-sectional view along line C—D in FIG. 4.

FIGS. 4 and 5 show a modification of the embodiment of FIG. 3. According to the embodiment of FIG.

3 the inlet channel 230 was located outside, in a direction of the longitudinal axis 25 of the pump, of the area of the cylinder body 4. In accordance with the embodiment of FIG. 4 the inlet channel 23 can remain in its position, as was already shown for the embodiment of FIG. 2, i.e. the inlet channel does not have to be located outside the area of the cylinder body. According to the embodiment of FIGS. 4 and 5 a reduced area 1 or 2 at the outer circumference of the cylinder body 4 provides for a connection between the swash plate chamber 29 and the piston bores 9. A circumferential slot 110 in the cylinder body 4 replaces the suction channels 11 which were present in the embodiment of FIGS. 1, 2 and also in the embodiment of FIG. 3.

FIG. 4 discloses in phantom lines the possibility of providing a slot 111. In case that radially inwardly located suction bores 10 are used, or in case that a radially inwardly located common suction chamber 109 is provided as shown in FIG. 4, the slot 111 provides for the connection between the bores 10 and said suction chamber 9, respectively, and the piston bores 9. Such a design could be used in the embodiment of FIGS. 1 and 2.

As far as possible, for the embodiments of FIGS. 3, 4 and 5 like reference numerals were used as were employed in the embodiment of FIGS. 1 and 2.

By providing inlet bores 100 in the embodiment of FIG. 3, for example, only above the middle axis 25 of the pump then good emergency running characteristics will be achieved for this embodiment. So as to obtain good emergency running characteristics for the embodiments of FIGS. 4 and 5, the reduced area 102 is, for example, also used only above the middle axis 25.

The pressure medium preferably is pressure oil.

Even though the pump of the invention is shown as a single circuit pump, the invention can also be used specifically for being applied in an automobile as a multiple circuit pump.

FIG. 6 discloses a still further embodiment of an axial piston pump 300. The basic design of the axial piston pump 300 is similar to the design of the pump shown in FIG. 1. For that reason, to a large extent, reference numerals similar to the ones used in FIG. 1 are also used in FIG. 6. Similar to the pump of FIG. 1 the axial pump 300 comprises a housing 1, a drive shaft 2, ball bearings 6, a swash plate 3, an axial bore 31 defining a swash plate chamber 29 and a cylinder body (piston support) 4 which abuts against a radially extending annular shoulder 30 formed by said bore 31.

Axial pistons 8 are located in piston bores 9. For example, eight bores 9 may be arranged on a circle. Radially and inwardly offset with respect to said bores 9 are inlet bores 10. The piston bores 9 define piston chambers 311 312 yet to be discussed.

Also, a middle bore 15 extends along the middle axis 25 of the housing within the cylinder body 4. A piston 16 is located in said bore 15. Further spring 17 urges said piston 16 against a ball 19 abutting against swash plate 3. Bore 18 is connected with the ball seat surface via channel 20. Again, similarly to the embodiment of FIG. 1 each piston 8 comprises a head 21 received in a piston support body 7.

The intake pressure medium is supplied to the swash plate chamber 29 by means of an inlet channel 23. The pressure medium is output from the pump via two outlet channels 302 and 307 provided in cover 306 which is mounted by means of bolts 26 to said housing 1.

Similarly to the embodiment of FIG. 1 a "pressure layering" condition occurs in the swash plate chamber 29. The existing pressure gradient provides for increasing pressure in the swash plate chamber 29 from the middle axis 25 towards the radially outer walls of said swash plate chamber 29.

In accordance with the invention at least two pluralities of piston chambers 311, 312 are provided. The first plurality of piston chambers 311 is connected via exhaust channels 313 and valve means 315 to an exit chamber 301 formed in said cover 306. The exit chamber 301 is connected via outlet channel 302 and a line 303 to first hydraulically operated means, for instance, the power steering apparatus 304 of a car. Reference numeral 305 refers to a sump.

It will be noted that a second plurality of piston chambers 312 is connected via exhaust channels 314 and valve means 316 to an outlet channel 307. Outlet channel 307 is connected via line 309 to second hydraulically operated means, for instance a hydraulically operated brake and/or clutch 301 of a vehicle.

For reasons explained above, the power steering apparatus 304 requires less pressure medium when the vehicle travels at high speeds. For that and other reasons, the apparatus 304 is supplied by piston chambers 311 which are supplied with pressure medium taken from a low pressure region of the swash plate chamber. Also, the first plurality of piston chambers 311 comprises more piston chambers than the second plurality of piston chambers 312. In the embodiment shown altogether eight piston chambers are provided and out of these eight piston chambers two piston chambers 312 are assigned to supply apparatus 309, while six piston chambers 311 are assigned to supply apparatus 304.

The two piston chambers 312 of the first plurality of piston chambers are diametrically oppositely arranged; to make it possible to show the two types of piston chambers 311 and 312, parts of the sectional view have been rotated by 90°. Consequently, FIG. 6 shows the two exhaust channels 313, 314 of the two piston chambers 312 (only one piston chamber 312 is shown). Further valve means 316 for both said exhaust channels 313, 314 are shown and besides passageway 320, also passageway 331 is shown. Both passageways 330 and 331 are connected and form passage way 332 which, in turn, leads to the outlet channel 307.

In contrast to the piston chambers 311 of the first plurality of piston chambers the piston chambers 312 of the second plurality of piston chambers are supplied with pressure medium taken from the high pressure region in the swash plate chamber 29. Consequently, axial bores 335 located radially outwardly with respect to middle axis 25 are provided in the body 4, so as to supply pressure medium from the high pressure region via radial bores 336 to the piston chambers 312. On the other hand, radially inwardly located axial bores 10 supply pressure medium from the low pressure region via bores 11 to the piston chambers 311.

The valve means 315 and 316 are of known design. Valve means 315 comprise a support plate 318 with valve plates 317 for closing and opening exhaust channel 313. Valve means 316 comprises a valve body 323 with passageways and also with a valve spring 322 biasing valve plate 321 into a position closing exhaust channel 314.

By providing at least two different groups or pluralities of piston chambers 311, 312 the different requirements of different hydraulic apparatus 304, 309 may be satisfied. By supplying pressure medium from different pressure regions different pump characteristics can be provided for the different hydraulic apparatus 304 and 309, respectively.

Pump 300 is particularly useful for a car. The first and larger plurality of piston chambers 311 will supply pressure medium, preferably oil, to the power steering apparatus 304, with the pressure medium being drawn from a low pressure region of the swash plate chamber 29. The second plurality of pressure chambers 312 will supply pressure medium to other hydraulically operated apparatus of the car, for instance, the brake, the clutch and a level adjustment means, respectively. The piston chambers 312 will be supplied with pressure medium from the high pressure region of the swash plate chamber 29.

The openings of the suction or inlet bores 10 and also of the axial bores 335 are arranged as close to the rotating surface of the swash plate 3 as possible. The specific ranges are similar to the ranges given for the embodiment of FIG. 1.

It should be noted that in practical embodiment line 302 typically comprises storage or accumulator means for the pressure medium, so as to improve operation.

It is claimed that:

1. An axial pump comprising:

a housing have a chamber and an inlet channel into said chamber for fluid;

a swash plate mounted for rotation in said chamber, rotation of said swash plate within said chamber producing a pressure gradient in the fluid disposed in said chamber adjacent the plate surface so that the pressure of fluid adjacent the central axis of said swash plate is less than the pressure of fluid adjacent the peripheral edge of said swash plate, the pressure gradient increasing with increasing rotational speed of said swash plate;

a plurality of axial pistons mounted for reciprocal axial movement in response to rotation of said swash plate to pump said fluid; and a cylinder housing having a plurality of piston bores each mounting one of said pistons having at least a single suction bore which is connected to one of said piston bores for supplying fluid to that piston bore, such suction bore having a single opening immediately adjacent said plate surface adjacent said central axis of said plate so as to be in communication with an area of low pressure fluid generated by said plate, said cylinder housing having a plurality of exhaust channels for transmitting fluid from said piston bores to an exhaust.

2. A pump as in claim 1 wherein a plurality of suction bores are radially and inwardly offset with respect to said piston bores.

3. A pump as in claim 1 wherein one suction bore is provided for each piston bore.

4. A pump as in claim 3 wherein said housing has a plurality of suction channels each connecting a suction bore to a piston bore.

5. A pump as in claim 1 further including a pressure guide element at each suction bore opening.

6. A pump as in claim 1 wherein said housing has a central bore further including a piston mounted in said bore, a ball at the outer end of said central piston and a spring in said central bore engaging said central piston for urging said ball against said swash plate.

7. A pump as in claim 1 wherein said suction bore is a circumferential slot.

8. A pump as in claim 7 wherein said slot cuts into said piston bore.

9. An axial pump comprising:

a housing having a chamber and an inlet channel into said chamber for fluid;

a swash plate mounted for rotation in said chamber, rotation of said swash plate within said chamber producing a pressure gradient in the fluid disposed in said chamber adjacent the plate surface so that the pressure of fluid adjacent the central axis of said swash plate is less than the pressure of fluid adjacent the peripheral edge of said swash plate, the pressure gradient increasing with increasing rotational speed of said swash plate;

a plurality of axial pistons mounted for reciprocal axial movement in response to rotation of said swash plate to pump said fluid; and a cylinder housing having a plurality of piston bores each mounting one of said pistons and having a plurality of suction bores each with a single opening disposed immediately adjacent said plate surface, each suction bore being connected to one of said piston bores for supplying fluid to that piston bore, at least one of said openings being defined immediately adjacent the central axis of said swash plate so as to be in an area of low pressure fluid generated by said swash plate and at least another of said openings being radially outwardly disposed relative to said at least one opening so as to be in an area of high pressure fluid generated by said swash plate, said cylinder housing having a plurality of exhaust channels for transmitting fluid from said piston bores to an exhaust.

10. A pump as in claim 9 wherein a plurality of suction bores are radially and inwardly offset with respect to said piston bores.

11. A pump as in claim 9 further including a pressure guide element at each suction bore opening.

12. A pump as in claim 9 wherein said housing has a central bore further including a piston mounted in said bore, a ball at the outer end of said central piston and a spring in said central bore engaging said central piston for urging said ball against said swash plate.

13. A pump as in claim 9 wherein one suction bore is provided for each piston bore.

14. A pump as in claim 13 wherein said housing has a plurality of suction channels each connecting a suction bore to a piston bore.

15. A pump as in claim 9 wherein at least one of said suction bores is a circumferential slot.

16. A pump as in claim 15 wherein said slot is at the outer circumference of said chamber.

17. A pump as in claim 16 wherein said slot cuts into said piston bore.

* * * * *